US008064295B2

(12) United States Patent
Palmer

(10) Patent No.: US 8,064,295 B2
(45) Date of Patent: Nov. 22, 2011

(54) MOTIVATIONAL ALARM

(76) Inventor: Robin B. Palmer, Westlake Village, CA (US)

( * ) Notice: Subject to any disclaimer, the term of this patent is extended or adjusted under 35 U.S.C. 154(b) by 0 days.

(21) Appl. No.: 11/897,753

(22) Filed: Aug. 31, 2007

(65) Prior Publication Data

US 2008/0089184 A1 Apr. 17, 2008

Related U.S. Application Data

(60) Provisional application No. 60/851,123, filed on Oct. 12, 2006.

(51) Int. Cl.
*G04B 19/00* (2006.01)

(52) U.S. Cl. ..... 368/274

(58) Field of Classification Search ..... 368/274, 368/111, 63, 10; 340/309.9, 309.16, 309.7, 340/309.8, 327, 331
See application file for complete search history.

(56) References Cited

U.S. PATENT DOCUMENTS

| | | | | |
|---|---|---|---|---|
| 3,420,051 | A | 1/1969 | Matteson | |
| 3,835,640 | A | 9/1974 | Hughes, Jr. | |
| 4,449,829 | A | 5/1984 | Ikemoto et al. | |
| D274,988 | S | 8/1984 | Mermelstein | |
| 4,706,288 | A | 11/1987 | Hashimoto et al. | |
| 5,369,797 | A | 11/1994 | Tyree | |
| D407,324 | S | 3/1999 | Bragg | |
| 6,427,078 | B1 * | 7/2002 | Wilska et al. | 455/550.1 |
| 6,483,782 | B1 * | 11/2002 | Steinbach | 369/6 |
| 6,589,058 | B2 | 7/2003 | Brooks | |
| 6,678,215 | B1 * | 1/2004 | Treyz et al. | 368/10 |
| 6,795,377 | B2 * | 9/2004 | Gorden | 368/12 |
| 6,816,060 | B2 * | 11/2004 | Dorr | 340/7.29 |
| 6,963,271 | B1 | 11/2005 | Fyffe | |
| 6,967,900 | B2 | 11/2005 | Chapman | |
| 6,998,961 | B2 | 2/2006 | Stihler | |
| 2002/0163860 | A1 | 11/2002 | Raines | |
| 2005/0169110 | A1 * | 8/2005 | Mazzilli et al. | 368/73 |

FOREIGN PATENT DOCUMENTS

JP 10300872 11/1998

* cited by examiner

*Primary Examiner* — Edwin A. Leon
(74) *Attorney, Agent, or Firm* — Craig A Crandall

(57) ABSTRACT

A motivational alarm having a timekeeping device; alarm programming means to produce an alarm signal at a programmed alarm time, the alarm programming means being operatively connected to the timekeeping device; a digital storage device operatively connected to the timekeeping device; a plurality of recorded messages recorded on the digital storage device; and playback means for converting at least a portion of the plurality of recorded messages into an audible signal upon receipt of the alarm signal. The recorded messages preferably have a topic related to exercise, spirituality, religion, religious text, esteem-building, health and wellness, encouragement for women, invigoration for long-term caretakers, wealth-building, or tragedy/loss recovery.

13 Claims, 4 Drawing Sheets

It is time to wake up and work out! (Rooster crows three times.)

'Good morning! This is your "Workout Wake Up Call!" It is a beautiful morning to wake up and workout! 'You know how great you are going to feel about yourself?! What an excellent way to start today!

Let's take a moment to wake up your body, while you are still in bed.
Please lie flat on your back and hug your right knee into your chest, while keeping your hips and left leg flat on the bed. Please inhale deeply for three counts... and then exhale for three counts. Switch legs and hug your left knee into your chest, while keeping your hips and right leg flat on the bed. Please inhale slowly for three and exhale for three. Please switch legs, inhale..., and exhale. Please switch legs once more, inhale..., and exhale...

'Excellent! You'll be glad you worked out this morning. You will be energized, focused, and feeling good about yourself and your abilities.
Exercise is an esteem builder. We just need to make space for our new building! It's a one day at a time process. Soon, you'll look back and you won't even recognize the person you used to be. You will just be grateful that you took the time to love and care for yourself. I am positive!

Here's a tip: It's best to set out your workout clothes each night before you go to bed, so you are set for success, without having to think about what you are going to wear! I also recommend that if you are using exercise equipment or a DVD player, that you set it up the night before so you are ready to go in the morning.

I will be right back!

(Music)

'Awesome! Now you can say, "I'm awake and I'm working out!" (Crowd applause)

All together now, "I'm awake and I'm working out!" (Crowd applause)

Please forward to the next track, turn off the alarm, and have a wonderful workout!

FIG. 5

MOTIVATIONAL ALARM

CROSS-REFERENCES TO RELATED APPLICATIONS

This patent application claims the benefit of U.S. Provisional Patent Application Ser. No. 60/851,123 filed Oct. 12, 2006 for Motivational Alarm, which application is incorporated here by this reference.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

TECHNICAL FIELD

This invention relates to motivational devices for inspiring users, particularly those inspiring users to exercise or perform another activity.

BACKGROUND ART

Many Americans seem to sit for a living, rush home to make dinner, and then sit down to eat with their families. Next, after attending to other home-related matters, they often fall into bed. When such people wake up in the morning, they often wish they had their own personal trainer that they could actually afford. They want to have a motivating fitness coach to encourage them to work out in the morning, before the day's schedule takes over. They need their own motivational alarm.

Many people want to get fit and stay fit, but are lacking the tools to accomplish this feat. Many of today's health issues can be linked to sedentary lifestyles and inactivity, and sadly it is a large piece of the American pie. Even with those who are physically fit, workouts are often hit or miss.

Therefore, what is needed is a consistent reminder to start each day on the right foot: a motivating personal trainer to jump start people out of bed and to provide an extra nudge to get people to work out in the morning. What is also needed is a system to enhance any success, motivation, or spiritual growth program.

DISCLOSURE OF INVENTION

The present invention meets those needs by supplying a method and device for providing an alarm having an integral message playing function, the messages being generally of a motivational or spiritual nature. The invention has a motivational speaker's recorded, motivating messages on CD, digital chip, or other medium, which may vary for each day of the month.

Preferably, the motivational alarm features a daily motivational or inspirational recorded message to boost the user out of bed on the right foot. Each CD or digital chip contains a month's worth of messages, and a new CD or chip may be delivered each month. In this way, the motivational alarm can bring world renowned and well-respected motivators and leaders to the user's home.

One broad aspect of the invention can be considered to be a motivational alarm having a timekeeping device; alarm programming means to produce an alarm signal at a programmed alarm time, the alarm programming means being operatively connected to the timekeeping device; a storage device operatively connected to the timekeeping device; a plurality of recorded messages residing on the storage device; and playback means for converting at least a portion of the plurality of recorded messages into an audible signal upon receipt of the alarm signal. The recorded messages preferably have a topic related to exercise, spirituality, religion, religious text, esteem-building, health and wellness, encouragement for women, invigoration for long-term caretakers, wealth-building, or tragedy/loss recovery.

Another broad aspect of the invention can be considered to be a method of providing motivation having the steps of providing a motivational alarm having a timekeeping device; alarm programming means to produce an alarm signal at a programmed alarm time, the alarm programming means being operatively connected to the timekeeping device; a storage device operatively connected to the timekeeping device; a plurality of recorded messages residing on the storage device, the plurality of recorded messages having a topic; and playback means for converting at least a portion of the plurality of recorded messages into an audible signal; setting a time for the alarm signal by way of the alarm programming means; playing at least one of the plurality of recorded messages upon receipt of the alarm signal by the playback device; and after at least one of the plurality of recorded messages is played, resetting the alarm signal such that the alarm signal will recur the following day.

BRIEF DESCRIPTION OF DRAWINGS

FIG. 5 is a transcription of an example of a daily message for versions of the invention where one of the messages is played back at each alarm time.

BEST MODE FOR CARRYING OUT THE INVENTION

Figure 1:
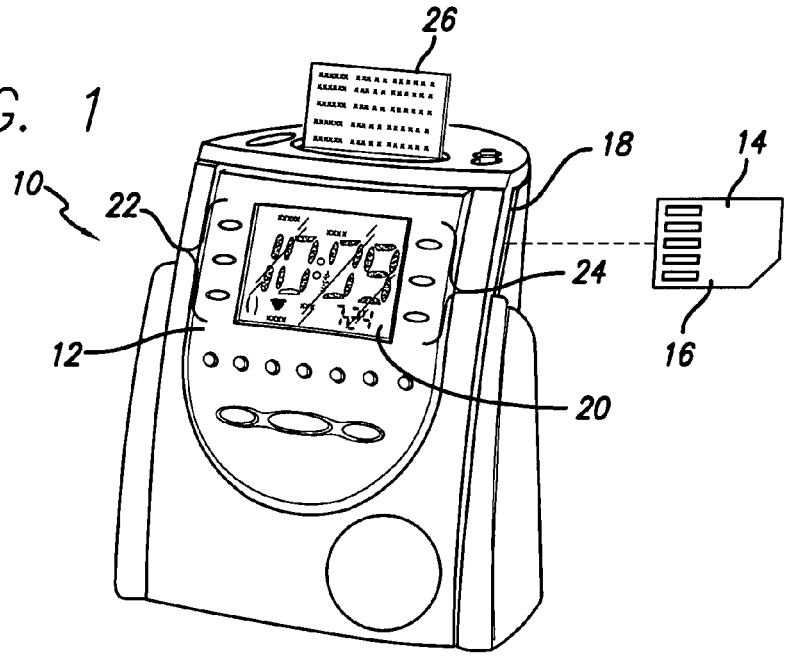
FIG. 1 is a perspective view of an embodiment of a motivational alarm.

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Referring to the figures, the motivational alarm 10 has a timekeeping device 12, a storage device 14, a plurality of recorded messages 16 stored or residing on the storage device 14, and a playback device 18. The motivational alarm 10 is configured to play one or more of the plurality of recorded messages 16 via the playback device 18 at a preset time or times.

The timekeeping device 12 generally has a clock face or display 20 to indicate the time and a mechanism for selecting or programming an alarm time. The alarm time is, for example, the time the user wishes to wake up in the morning. The alarm programming means 22 is typically by way of circuitry and methods known in the art and may include push buttons, switches, or a combination of them.

The timekeeping device 12 may also have an alert setting. The alert setting may be set for various intervals to enable the user to set the amount of preparation time needed, for example, to wake up and be ready to work out to an exercise DVD. Preferably, the alert settings may be set to five, ten, or fifteen minutes, analogous to a "snooze" setting on a typical alarm clock. The alert setting means 24 is generally by way of circuitry and methods known in the art and may include push buttons, switches, or a combination of them.

Figure 2:
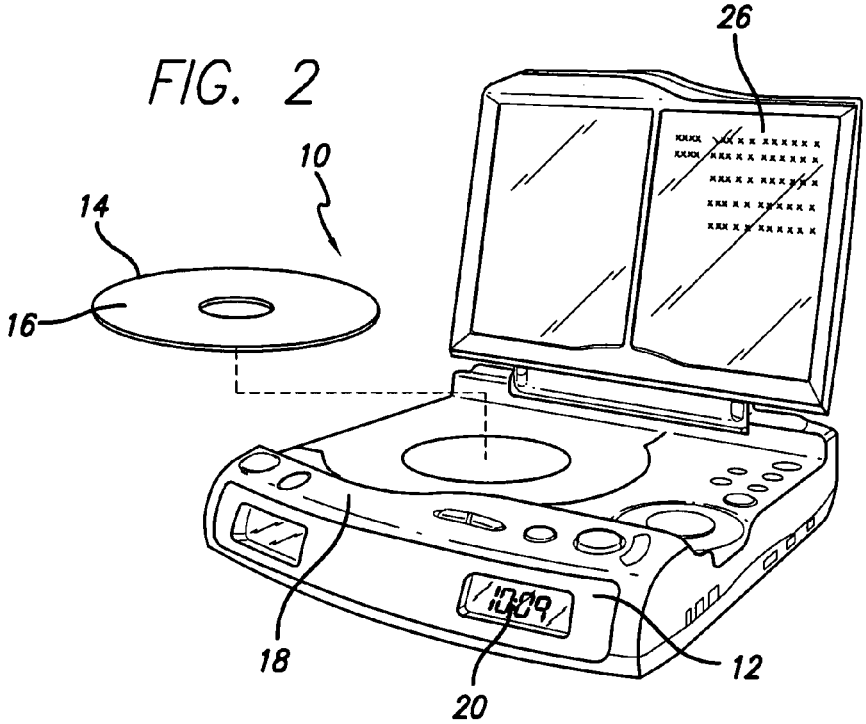
FIG. 2 is a perspective view of another embodiment of a motivational alarm, showing an example of an incorporated CD player.

The timekeeping device 12 may also include a curio 26, and the curio 26 may be used to provide visual inspiration to the user. Preferably, the curio 26 is related to the plurality of recorded messages 16. By way of example, if the plurality of recorded messages 16 pertains to religion, then the curio 26 may be a religious figure or text. If the messages 16 concern exercise and fitness, the curio 26 may provide dietary instructions and encouragement. Likewise, if the messages 16 involve coping with a loss, then the curio 26 may depict a coping strategy or tranquil, graphical representation. The curio 26 may be a figurine, such as a characterization of a fitness trainer, spiritual adviser, or other inspirational figure. For example, a figurine may depict a fitness trainer standing with his or her hands on their hips and their feet spaced shoulder width apart. Additionally, the curio 26 may be an affirmation card or inspirational card, containing words or images of an inspiring, soothing, or encouraging nature. The curio 26 may also be a depiction on a screen, such as an LCD monitor, an example of which is depicted in FIG. 2.

The playback device 18 may be any mechanism capable of converting the recorded message into an audible signal using technology known in the art, such that the recorded message may be heard by the user. The playback device 18 may be, for example, a CD player or MP3 player, and the playback device 18 is preferably incorporated with the timekeeping device 12 to provide an integrated system.

The plurality of recorded messages 16 resides on the storage device 14. The storage device 14 may be a compact disk, digital chip or drive, cassette tape, or other removable or non-removable media recording device. The recorded messages 16 generally are motivational, meditative, spiritual, inspirational, or relate to visualization cues, and they may contain, for example, information or encouragement about exercise, diet, or spirituality. The recorded messages 16 typically are recordings of a human voice speaking, although they may include additional elements, such as music.

Figure 3:
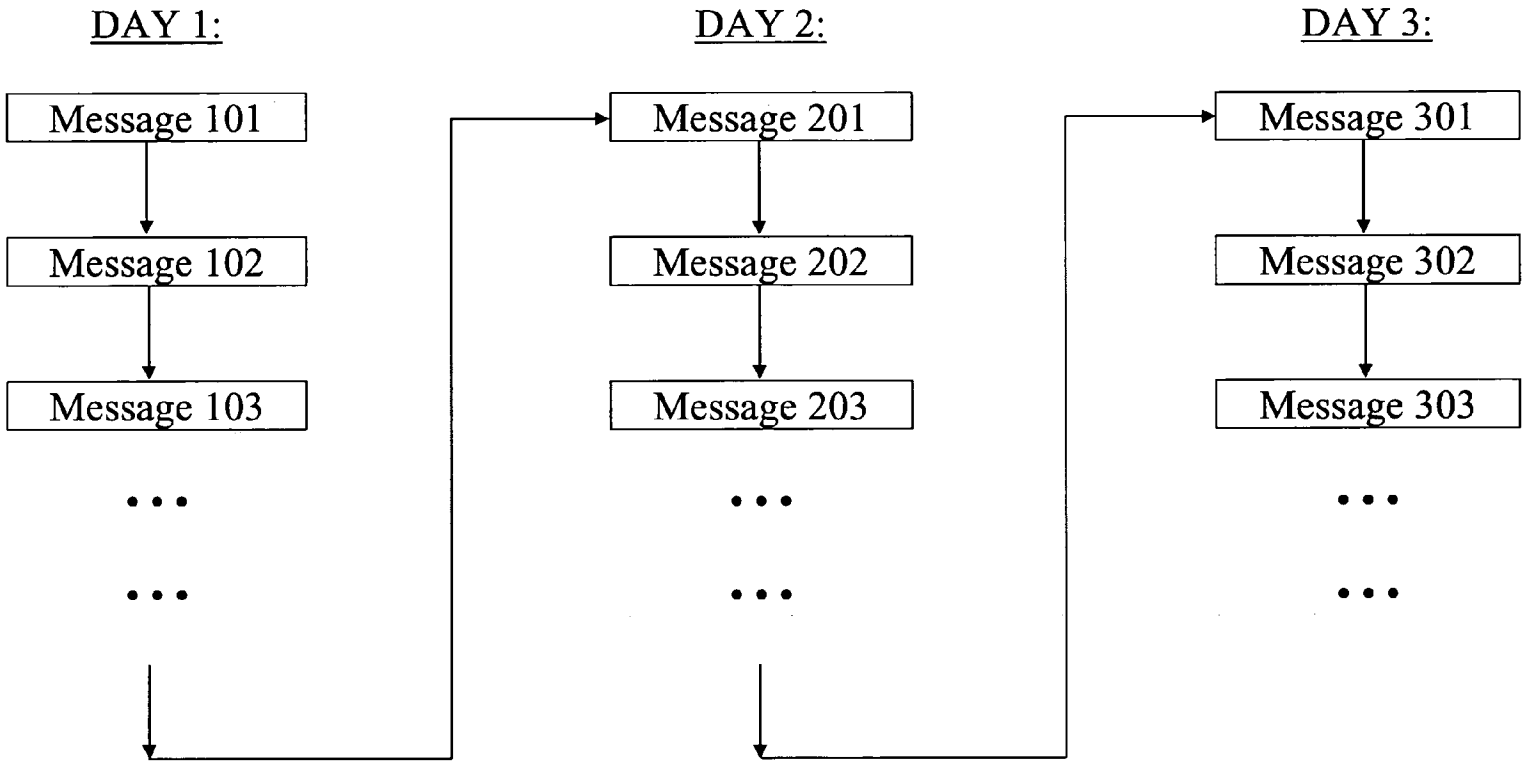
FIG. 3 is a flowchart showing a sequence of a plurality of recorded messages in an embodiment of a motivational alarm.

In a version of the invention, for each preset alarm time (for example, generally corresponding to each morning), a series of messages will play, starting with a first recorded message from the plurality of recorded messages 16, and followed by one or more subsequent recorded messages played at the time specified by the alert setting. An example of this version is depicted graphically in FIG. 3, where a message 101 is played at the preset alarm time and is followed by a message 102, message 103, etc. at the expiration of a first, second, etc. alert interval. Each storage device 14 may contain a different series of messages for a period of days, such as a thirty-day period.

Specifically, a sequence of messages might be something like this:

At the preset alarm time: "Hi, I'm Robin Palmer and this is your wake up call! I am so excited to be a part of making your exercise program a success! I know you'll enjoy our workout together and be glad you started your day with a good exercise program. It's the best way to have a successful start to your day. I know that it will have an impact on you both mentally and physically. You'll be glad you worked out at the beginning of the day when you are fresh, alert and vibrant with energy! So come on, get out of bed and meet me in front of your TV in 15 minutes."

At the first alert setting interval: "How's it going? I'm looking forward to our workout together and I hope you are too! You will be energized, raring to go, and feel good about yourself and your abilities."

At the second alert setting interval: "Please make sure that you are wearing comfortable exercise clothes and proper fitting sneakers for your workout with me. I also recommend that you set up your core exercise ball, dumbbells, and DVD player each night so that you are ready to go."

At the third alert setting interval (the final interval for this example): "Ok! I hope you are ready to workout! I'm looking forward to it! Press play on your DVD player! Come on, let's go!"

Figure 4:
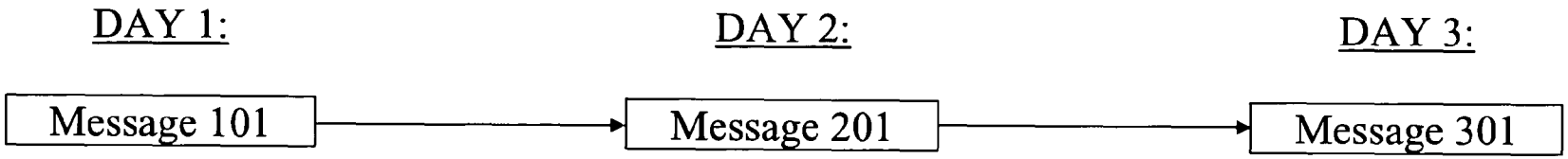
FIG. 4 is a flowchart showing another sequence of a plurality of recorded messages in an embodiment of a motivational alarm.

In another version of the invention, just one of the plurality of messages 16 is played back at each alarm time. Preferably, the alarm time is programmed to occur once per day, such as the time the user wishes to awake in the morning. In this "daily" version, a different one of the plurality of messages 16 may be played each day. An example of this version is depicted graphically in FIG. 4, where a message 101 is played at the alarm time on the first day, a message 102 is played at the alarm time on the second day, a message 103 is played at the alarm time on the third day, etc. A transcription of an example of a daily message is provided in FIG. 5. Although it is presently preferred that this version does not include the alert, or snooze, feature discussed, it is contemplated that the alert feature may be incorporated into daily versions.

In a version of the invention, the messages are played in an order determined by a programmed sequence, such as the order of the tracks on a CD. In another version, the messages may be played in a random order, for example, by a CD player or MP3 player having a shuffle function. Furthermore, the programmed and shuffle modes may be used in combination to, for example, present the messages in the programmed sequence for a first period of days (e.g., a first thirty-day period) and then shuffle the messages for a second period of days (e.g., another thirty-day period).

The method of using the motivational alarm 10 includes providing a user with a timekeeping device 12, a plurality of recorded messages 16 residing on a storage device 14, and a playback device 18. The motivational alarm 10 is configured to play one or more of the plurality of recorded messages 16 via the playback device 18 at a preset time or times.

In an embodiment of the invention, the user sets an alarm time by the alarm programming means 22. In some versions, the user may also select an alert interval by the alert setting means 24. At the preset alarm time, the motivational alarm 10 begins to play a first recorded message. After a delay corresponding to an alert setting (e.g., a "snooze" time), the alarm plays a second recorded message. Similarly, a third and subsequent recorded messages may be played at the respective intervals of the alert setting. As such, a spoken prompt is delivered periodically, such as every few minutes.

In another embodiment of the invention, one of the plurality of messages 16 is played back at each alarm time. The user sets the alarm time on the clock by the alarm programming means 22, and at the set time, the motivational alarm 10 begins to play one of the plurality of messages 16. After the recorded message is played, the alarm signal is reset such that the alarm signal will recur the following day at the time specified by the alarm programming means 22.

It is contemplated that the motivational alarm 10 might be bundled with other commercially available products, particularly self-help products such as workout or motivational packages. For example, the motivational alarm 10 may be included with a DVD exercise video by an established fitness instructor or along with a book by a psychologist regarding how to deal with the loss of a close relative.

In an embodiment of the invention, the user would periodically acquire a new storage device 14, such as every two weeks, one month, or two months. Alternatively, the storage device 14 might periodically have new recorded messages stored on it. These new recorded messages might be downloaded to the storage device 14, for example, via an Internet website or through a wireless telephone service. In some versions, the user may record their own messages onto the storage device 14. In an embodiment of the invention, the user would subscribe to periodically receive a replacement storage device 14 or a replacement plurality of recorded messages 16, such as every two months.

While the present invention has been described with regards to particular embodiments, it is recognized that additional variations of the present invention may be devised without departing from the inventive concept.

INDUSTRIAL APPLICABILITY

This invention may be industrially applied to the development, manufacture, and use of motivational devices for inspiring users, particularly those that inspire users to get up out of bed and exercise or to perform another activity.

What is claimed is:

1. An integrated motivational alarm system, comprising:

(a) a timekeeping device comprising an alarm programming/alert setting mechanism capable of being programmed to produce one or more alarm signals when one or more pre-set programmed alarm settings is reached;

(b) a storage device operatively connected to the timekeeping device and comprising a plurality of specially structured, sequentially programmed recorded messages; said messages comprising a recorded, human, spoken voice and having a selected topic;

(c) a playback means incorporated within said timekeeping device and capable of converting one or more of said plurality of recorded messages into an audible signal upon receipt of each of one or more of said alarm signals;

wherein said integrated system is configured and programmed such that said converted one or more plurality of recorded messages is played back in a sequential preprogrammed order upon receipt of each of one or more of said alarm signals; and wherein upon receipt of at least one of said converted plurality of recorded messages, a user is inspired to perform an activity associated with said selected topic.

2. The motivational alarm system of claim 1 further comprising means for providing visual inspiration to a user, the visual inspiration corresponding to the topic of the recorded message.

3. The motivational alarm system of claim 2, the means for providing visual inspiration comprising a figurine.

4. The motivational alarm system of claim 2, the means for providing visual inspiration comprising an inspirational card.

5. A method of providing motivation to a user to perform a selected activity, comprising the steps of:

(a) providing an integrated motivational alarm system comprising a timekeeping device comprising an alarm programming/alert setting mechanism capable of being programmed to produce one or more alarm signals when one or more pre-set programmed alarm settings is reached; a storage device operatively connected to said timekeeping device and comprising a plurality of specially structured, sequentially programmed recorded messages; said messages comprising a recorded, human, spoken voice and having a selected topic; and playback means incorporated within said timekeeping device and capable of converting one or more of said plurality of recorded messages into an audible signal upon receipt of each of one or more of said alarm signals;

(b) programming one or more alarm settings to produce one or more alarm signals as each of said one or more alarm settings is reached by way of the alarm programming mechanism; and (c) playing one or more of said converted plurality of recorded messages in a sequential preprogrammed order upon receipt of each of one or more said alarm signals by way of the playback means.

6. The method of claim 5 further comprising providing visual inspiration to a user, the visual inspiration corresponding to the topic of the recorded message.

7. The method of claim 6, the step of providing visual inspiration comprising providing a curio.

8. The method of claim 5, the provided motivational alarm system being bundled with a commercially available self-help product.

9. The method of claim 5, the plurality of recorded messages being transmitted by a subscription agreement.

10. The method of claim 5 further comprising the step of the user periodically acquiring a replacement storage device having a second plurality of recorded messages.

11. The method of claim 5 further comprising the step of periodically recording a replacement plurality of recorded messages onto the storage device.

12. The method of claim 11, the replacement plurality of recorded messages being downloaded to the storage device via an Internet website or through a wireless telephone service.

13. The method of claim 11, the replacement plurality of recorded messages being recorded onto the storage device by the user.

* * * * *